US011560678B2

(12) United States Patent
Llobet

(10) Patent No.: US 11,560,678 B2
(45) Date of Patent: Jan. 24, 2023

(54) FORKLIFT SAFETY DEVICE AND METHOD

(71) Applicant: Montserrat Llobet, Hermosa Beach, CA (US)

(72) Inventor: Montserrat Llobet, Hermosa Beach, CA (US)

( * ) Notice: Subject to any disclaimer, the term of this patent is extended or adjusted under 35 U.S.C. 154(b) by 954 days.

(21) Appl. No.: 16/384,775

(22) Filed: Apr. 15, 2019

(65) Prior Publication Data

US 2019/0316306 A1 Oct. 17, 2019

Related U.S. Application Data

(60) Provisional application No. 62/657,640, filed on Apr. 13, 2018.

(51) Int. Cl.

| | |
|---|---|
| ***E01F 13/02*** | (2006.01) |
| ***B66F 17/00*** | (2006.01) |
| ***E01F 13/04*** | (2006.01) |

(52) U.S. Cl.

CPC ..... *E01F 13/028* (2013.01); *B66F 17/003* (2013.01); *E01F 13/04* (2013.01)

(58) Field of Classification Search

CPC ..... E01F 13/022; E01F 13/028; E01F 13/04; B66F 17/003

See application file for complete search history.

(56) References Cited

U.S. PATENT DOCUMENTS

| | | | | |
|---|---|---|---|---|
| 3,485,391 A | | 12/1969 | Johns | |
| 4,524,953 A | | 6/1985 | Phillips et al. | |
| 4,844,420 A | * | 7/1989 | Oster | B65H 75/48 49/34 |
| 5,011,363 A | | 4/1991 | Conley, III et al. | |
| 6,375,164 B1 | | 4/2002 | Siegler et al. | |
| 6,739,567 B1 | | 5/2004 | Curtis | |
| 7,690,858 B1 | * | 4/2010 | Chiavola | E01F 13/028 340/908 |

(Continued)

FOREIGN PATENT DOCUMENTS

| | | |
|---|---|---|
| EP | 0287510 | 10/1988 |
| EP | 0352071 | 1/1990 |

(Continued)

OTHER PUBLICATIONS

"Double Wall Mount . . . " http://34.241.193.55/suppliers/discount-displays-1381911/products?page=2&size=10&category=products.printing_and_display.display_solutions.queue_barriers.

(Continued)

*Primary Examiner* — Daniel J Wiley
(74) *Attorney, Agent, or Firm* — Cislo & Thomas, LLP

(57) ABSTRACT

A safety device that prevents tripping over forklifts or other material handling equipment includes a stand attachable to the horizontal fork and a pole of adjustable length extending upward. The device further includes a retractable barrier extending from the top of the pole across to the vertical mast of the forklift. The device preferably incorporates magnets which attach it to an idle forklift as described, and also attach the collapsed device to other portions of the vehicle when in use moving goods. This keeps the device conveniently available for use when the forklift is idle. And when the barrier is erected, nearer eye level, well above the floor, despite the forks sticking out in the aisle, persons passing by are much more likely to notice the forks and step around them.

3 Claims, 7 Drawing Sheets

(56) References Cited

U.S. PATENT DOCUMENTS

| | | | | |
|---|---|---|---|---|
| 7,896,307 | B2 | 3/2011 | Berg | |
| 8,078,368 | B2 | 12/2011 | Hall | |
| 8,490,668 | B2 | 7/2013 | Snyder et al. | |
| 8,631,755 | B2 | 1/2014 | Klein et al. | |
| 9,074,331 | B2 | 7/2015 | Stender et al. | |
| 9,175,450 | B2 | 11/2015 | Weiner | |
| 9,598,896 | B1 * | 3/2017 | Pichik | E06B 9/60 |
| 2005/0168818 | A1 * | 8/2005 | Hudson, Jr. | B65H 75/446 359/515 |
| 2010/0044661 | A1 * | 2/2010 | Weiner | E01F 9/685 256/1 |
| 2011/0222962 | A1 * | 9/2011 | Jette | E01F 13/06 404/6 |
| 2012/0234990 | A1 * | 9/2012 | Lewis | E01F 13/00 248/219.2 |
| 2013/0032773 | A1 | 2/2013 | Jette | |
| 2015/0137057 | A1 * | 5/2015 | Weiner | E01F 13/028 256/40 |
| 2015/0218848 | A1 * | 8/2015 | Weiner | B65H 75/4471 256/47 |
| 2017/0032720 | A1 * | 2/2017 | Yang | G09F 15/0056 |
| 2017/0038004 | A1 * | 2/2017 | Kalinski | E01F 13/028 |
| 2017/0167093 | A1 | 6/2017 | Punzengruber | |
| 2018/0002944 | A1 * | 1/2018 | Torsiello | E01F 13/024 |
| 2018/0044868 | A1 * | 2/2018 | Miller | E01F 13/028 |
| 2018/0079636 | A1 * | 3/2018 | Dixon | B66F 9/07 |

FOREIGN PATENT DOCUMENTS

| | | |
|---|---|---|
| KR | 20170062018 | 6/2017 |
| WO | WO2017146562 A1 | 8/2017 |

OTHER PUBLICATIONS

"Magnetic Post—Tensabarrier" http://www.tensabarrier.com/product/magnetic-post/.

"Wall Mount Retracta-Belt Unit . . . " https://www.discountdirectionals.com/product/412-series-wall-mount-retracta-belt/.

"Beltrac Lavi Magnetic Wall Mount Barrier—13 ft Belt" https://www.crowdcontrolstore.com/magnetic-wall-mount-belt-barrier-stanchion-with-13-foot-belt?utm_source=google . . .

"Wall Mount Belt Barrier—Magnetic Mount Black . . . " https://www.prostanchions.com/products/magnetic-wall-mount-barrier-10-foot-black-retracta-belt-prime?variant=450751117.

"Lavi Retractable Belt Barrier 7-Foot Magentic . . . " https://www.securityprousa.com/products/lavi-7-foot-magnetic-retractable-belt-barrier.

"Magnetic Base Floor Mount for Crowd Control Stanchions" https://www.lavi.com/en/product-detail/magnetic-base-stanchion.

"Tensabarrier Mag . . . " https://www.crowdcontroldirect.com/Tensabarrier-Magnetic-Belt-End-p/tbeltend-d.htm?gclid=EAIaIQobChMIuozV47b74gIVhLfsCh1vvQsyEAQYASABEgKhvvD_BwE&gdffi . . .

"Buy Storetrac Mono—. . . " https://www.barriers4u.co.uk/storetrac-mono-with-magnet-base.

"Magnetic Retractable Safety . . . " https://www.calpaclab.com/magnetic-retractable-safety-barrier-30-security-tape-with-light/bnr-mh5003I.

"Beltract Storetrac Double . . . " https://www.whitelightdisplay.co.uk/freestanding-retractable-barriers/beltrac-storetrac-retractable-belt-barrier.html.

"Cisco-Eagle Catalog—Portable . . . " https://www.cisco-eagle.com/catalog/product/182611/portable-safety-zone-barricade-system-100-fencing-w4-posts-base-pads-and-fence-clips.

* cited by examiner

FORKLIFT SAFETY DEVICE AND METHOD

BACKGROUND

According to the National Safety Council, injuries sustained from tripping and falling are a major contributor to serious injuries and even unintentional death in the United States. In 2014 more than 31,000 people died from injuries sustained from a fall. These types of injuries account a large number of general industrial incidents, often resulting in workers compensation claims. Additionally, these types of injuries sustained in areas open to the public may result in personal injury lawsuits against the establishment.

Warehouses, construction sites, factories, automobile repair facilities and the like often have material handling tools and other machinery such as forklifts or pallet jacks temporarily or semi-permanently stationed throughout. Most warehouse stores such as Home Depot or Costco are heavily crowded by the consuming public where products are mostly placed and displayed on pallets. Employees often use forklifts or pallet jacks to move the pallets during and after business hours. In the automobile repair shop setting, automobiles are lifted by car lift machines which include floor plates or drum grips. When not in use, unsuspecting consumers or employees may trip over or walk into a low-sitting portion of the machinery such as the forks of a forklift, pallet jack or car lift machine, or the bed of a low-sitting platform truck cart.

Safety barriers may be used to surround the entire machinery or a portion thereof in the form of posts with safety nets, retractable belts or hazard tape therebetween. Alternatively, if a machine operator leaves machinery in a warehouse aisle, the entire aisle may be closed to prevent pedestrians from walking by. While such devices can provide effective barricades, they generally require multiple posts to surround the machinery and present problems such as a time-consuming installation requiring one or more persons, and the need for a large area to store the devices when not in use. Another problem to be solved with current safety devices is that once a user decides to set up the device, the user must leave the machinery unattended to retrieve the safety device and an unsuspecting pedestrian may trip over the machinery during that time.

For the foregoing reasons, what is needed is a safety apparatus to serve as a barrier and to provide sufficient notice to pedestrians of a machinery trip hazard. Further, the safety apparatus should be able to be quickly assembled by a single user, and preferably attachable directly to machinery for riding along with the machinery when not in use.

SUMMARY

A safety device attachable to a forklift vehicle having a horizontal fork and a vertical mast, includes a pole, preferably of adjustable length, and at its lower end a stand and extending vertically upward. The stand is releasably attached, preferably through use of a magnet, to the horizontal fork when deploying the safety device. A retractable belt is attached to the upper end of the stand and horizontally extends to near the vertical mast of the forklift where it is similarly releasably attached, preferably by a magnet. And when the safety device is not deployed, and instead in storage while the forklift is being used to move goods, the pole is releasably attached, preferably by one or more magnets, to other portions of the vehicle away from the horizontal fork.

A method for preventing tripping over a material handling machine having a substantial vertical portion and a substantial horizontal portion near the ground with a distal end extending into an aisle, include steps of attaching a pole to the distal end of the substantial horizontal portion extending upwardly when the material handling machine is idle. Another step is extending a retractable barrier horizontally from near the top end of the pole towards the substantial vertical portion and attaching it there. The method may further include adjusting the length of the pole. The attaching steps may be accomplished by positioning a magnet on the safety device near portions of the metallic the material handling machine. When preparing to use the material handling machine to move goods, the steps are reversed and the safety device is detached, the barrier retracted, and the pole may be collapsed. Then the device is attached to the machine and held in storage for next use when the machine is idle.

DETAILED DESCRIPTION

Figure 3:
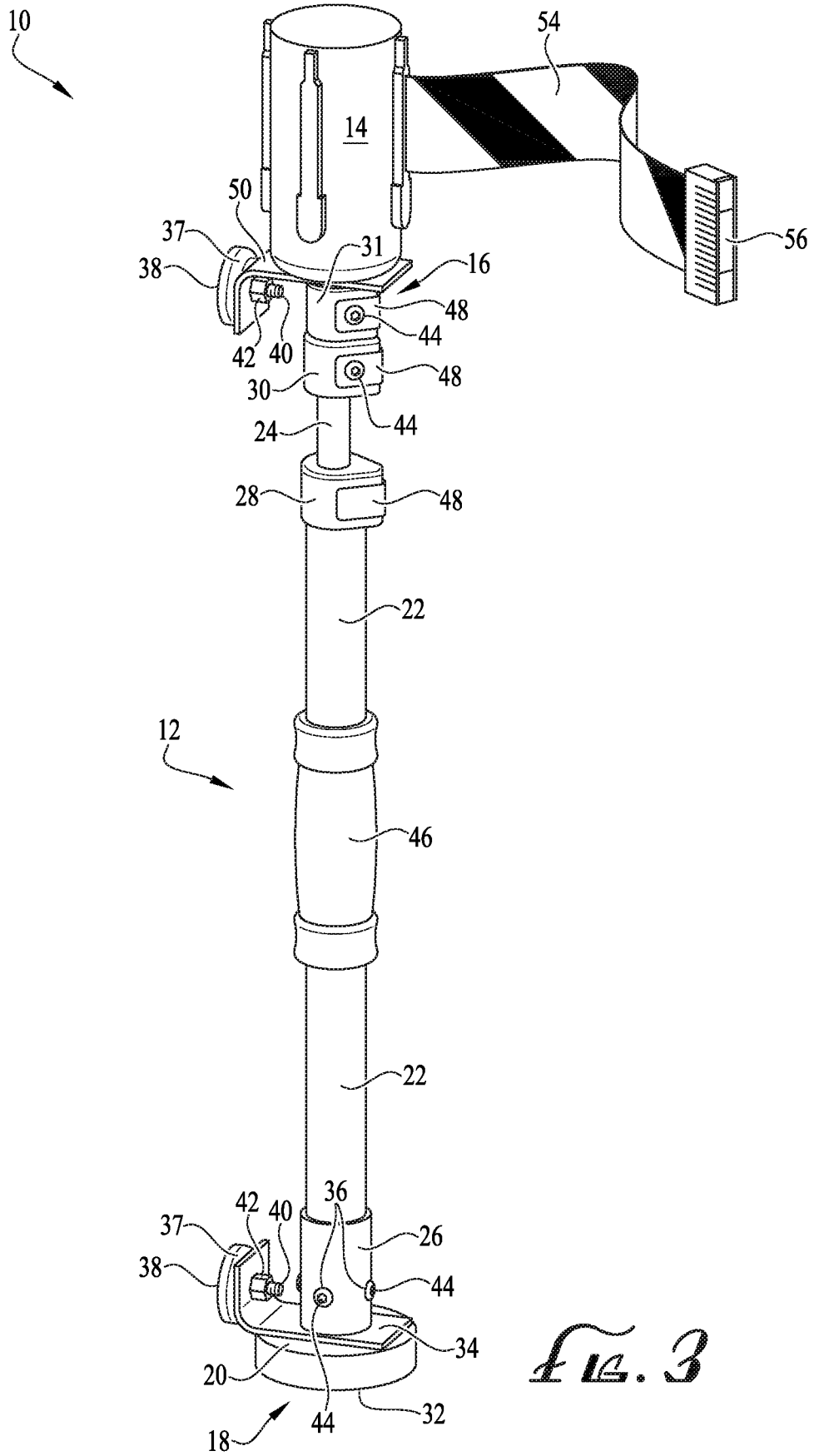
FIG. 3 illustrates a perspective view of the forklift safety apparatus pole with attached retractable stanchion belt.

FIG. 3 illustrates a forklift safety device apparatus 10 having an extendable pole 12 and retractable stanchion belt housing unit 14. The extendable pole 12 includes a top end 16, a bottom end 18, a bottom post 20, a first extendable portion 22, a second extendable portion 24, a first extendable portion connector 26, a second extendable portion connector 28, a first top end connector 30 and a second top end connector 31. The first extendable portion 22 and first extendable portion connector 26 are preferably hollow for easy insertion of other components of the extendable pole 12. The bottom end 18 of the extendable pole 12 includes a bottom post 20 and a bottom post magnet 32 (not shown) adhesively or otherwise affixed to the bottom post 20. In a preferred embodiment, the magnet 32 (not shown) is a 420-pound neodymium cup magnet, the magnetic pull of which is strong enough to enable the apparatus 10 to securely stand upright on a metal surface.

Still referring to FIG. 3, a first L-shaped fixture 34 is adhesively or otherwise affixed to the bottom post 20 opposite the bottom post magnet 32 and the first extendable portion connector 26 is affixed to the first L-shaped fixture 34 opposite the bottom post 20 by welding or other means. The first L-shaped fixture 34 is preferably made of an alloy metal folded at substantially ninety degrees. A storage portion magnet 38 (see FIGS. 4-5) is adhesively or otherwise affixed to a storage portion 37, and a storage portion post 40 is adhesively or otherwise affixed to the storage portion 37 opposite the storage portion magnet 38. In a preferred embodiment, the storage portion magnet 38 is a 120-pound neodymium cup magnet. The first L-shaped fixture 34 is affixed to the storage portion 37 by the storage post 40 and a fastener 42. Optionally, the storage portion 37 lacks a storage portion post 40 and may affix to the portion of the first L-shaped fixture 34 perpendicular to the bottom post 20 by welding or other means.

Still referring to FIG. 3, the first extendable portion connector 26 is affixed to the first L-shaped fixture 34 opposite the bottom post 20 by welding or other means. The first extendable portion connector 26 preferably has one or more holes 36 adjacent to the first L-shaped fixture 34. In a preferred embodiment, the first extendable portion 22 inserts into the first extendable portion connector 26 and preferably secures into place by placing and tightening screws 44 into the holes 36 of the first extendable portion connector 26. Optionally, the first extendable portion 22 affixes to a non-hollowed first extendable portion connector 26 by welding or other means. The first extendable portion 22 has a foam grip 46 located preferably at the center of the first extendable portion 22 to enable a user to comfortably hold the first extendable portion 22 while adjusting the extendable pole 12 to a user's desired height.

Continuing to refer to FIG. 3, the second extendable portion connector 28 is adhesively or otherwise affixed to the first extendable portion 22 opposite the first extendable portion connector 26. The second extendable portion connector 28 includes a clamp 48 and is preferably ring-shaped with an opening in the center, sized to receive the second extendable portion 24. The second extendable portion 24 inserts into the opening of the second extendable portion connector 28 and the hollowed portion of the first extendable portion 22. The clamp 48 of the second extendable portion connector 28 enables the user to lock the position of the second extendable portion 24 relative to the first extendable portion 22 to achieve a desired height of the apparatus 10. The first top end connector 30 is adhesively or otherwise affixed to the second extendable portion 24 opposite the end inserted into the second extendable portion connector 28 and second extendable portion 24. In a preferred embodiment, a second top end connector 31 is positioned above the first top end connector 30 with a third extendable portion therebetween. The first top end connector 30 and second top end connector 31 include a clamp 48 in a semi-permanently locked position preferably by placing a screw 44 through the clamp 48. The third extendable portion is housed within the interior of the second extendable portion 24 and first extendable portion 22. Alternatively, the screw 44 from the first top end connector 30 may be removed, allowing a user to extend the third extendable portion to achieve a desired height and locking the extendable pole 12 in place by engaging the clamp 48 of the first top end connector 30.

Still referring to FIG. 3, a second L-shaped fixture 50 is adhesively or otherwise affixed preferably to the second top end connector 31 and the retractable stanchion belt housing unit 14 is adhesively or otherwise affixed to the second L-shaped fixture 50 opposite the first top end connector 30. Alternatively, the extendable pole 12 lacks a second top end connector 31 and the second L-shaped fixture 50 adhesively or otherwise affixes to the first top end connector 30. As with the first L-shaped fixture 34, the second L-shaped fixture 50 is preferably made of an alloy metal folded at substantially ninety degrees. The second L-shaped fixture 50 is affixed to a storage portion 37 by a storage post 40 and a fastener 42. Optionally, the storage portion 37 lacks a storage portion post 40 and may affix to the portion of the second L-shaped fixture 50 perpendicular to the bottom post 20 by welding or other means. The retractable stanchion belt housing unit 14 includes a retractable belt 54. At one end of the retractable belt 54 is a belt magnet 56 which magnetically affixes to a metal surface.

Figure 1:
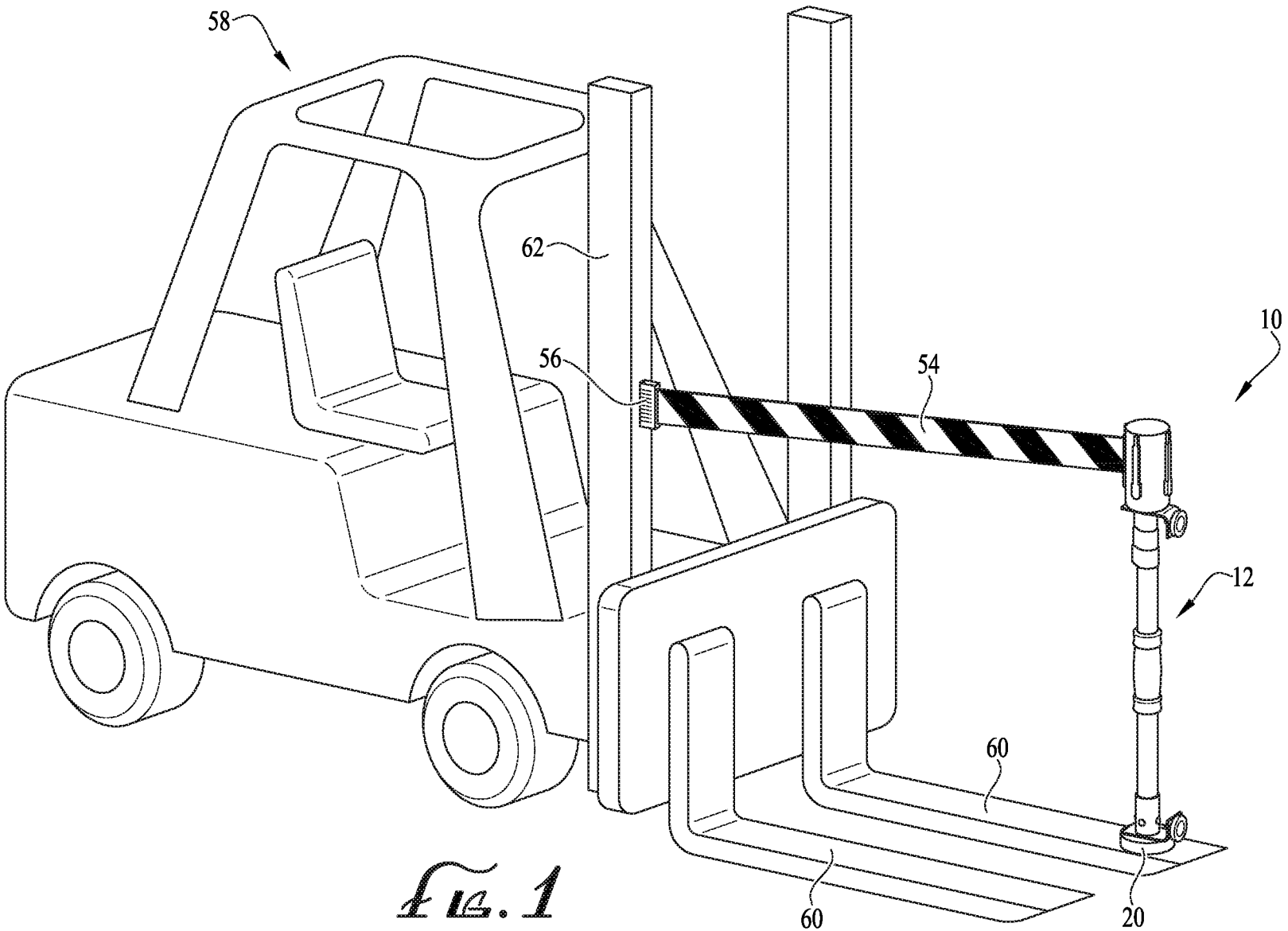
FIG. 1 illustrates a perspective view of a forklift safety apparatus in use on an idle forklift machine.

Referring to FIG. 1, the apparatus 10 is affixed to a forklift 58 by magnetically affixing the bottom post 20 onto a horizontal fork 60 of the forklift 58. The retractable belt 54 is extended and the belt magnet 56 is magnetically affixed to a vertical metallic portion of the forklift 58, preferably the mast 62. The user will preferably extend and lock the extendable pole 12 at a height by which to alert pedestrians of the presence of the horizontal fork 60 which will prevent pedestrians from walking and tripping over the horizontal fork 60. Although a user may accomplish the goal of alerting pedestrians of the presence of a horizontal fork 60 with one apparatus 10, the user may optionally elect to use an additional apparatus 10 to place atop a separate horizontal fork 60 and extend the retractable belt 54 to a vertical portion of the forklift 58.

Figure 2:
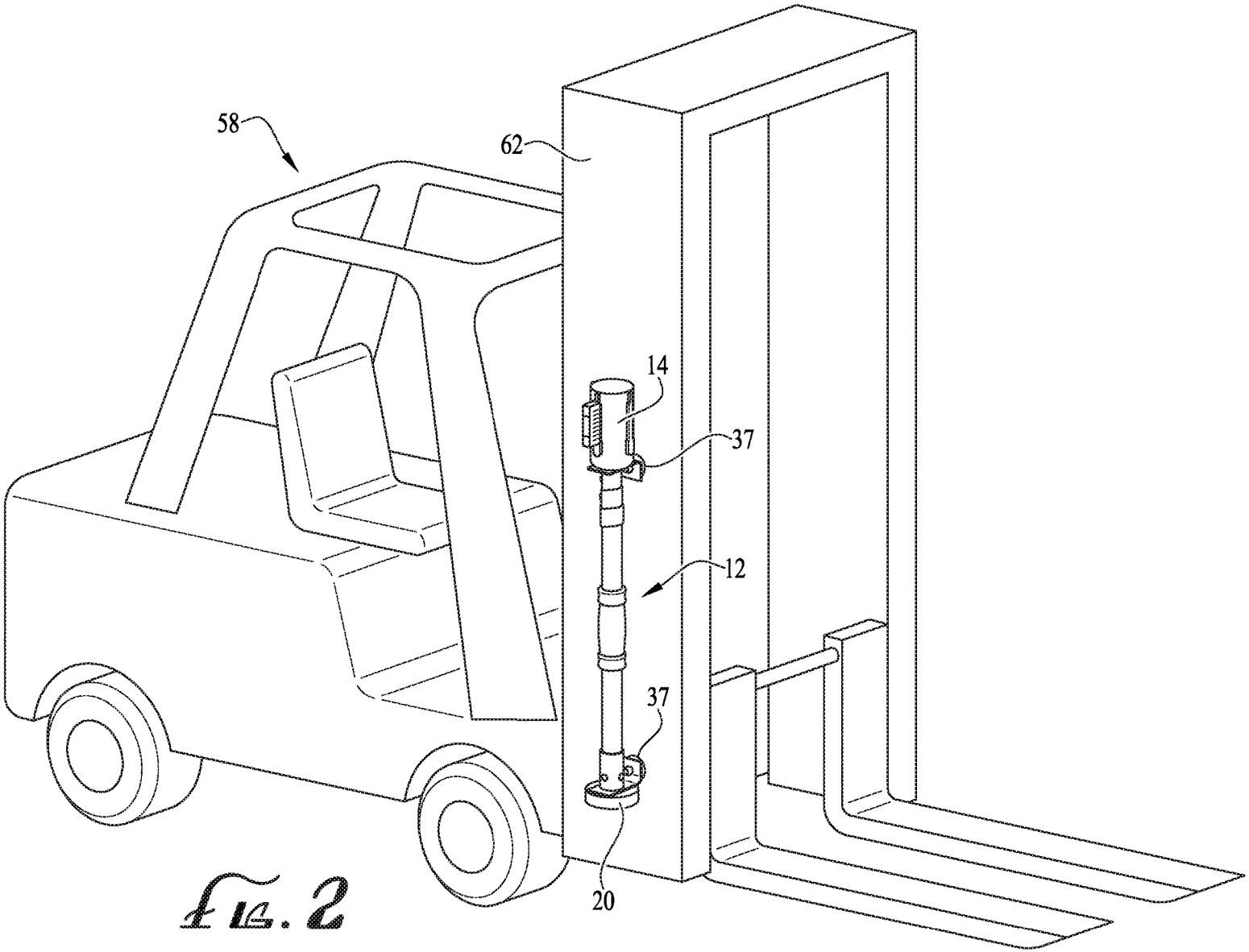
FIG. 2 illustrates a perspective view of the apparatus affixed to the mast of a forklift during storage.

Referring to FIG. 2, the apparatus 10 is magnetically affixed to a metallic vertical portion of a forklift 58, preferably the mast 62, by magnetically affixing the storage portion 37 of the apparatus 10 to a metallic vertical portion of the forklift 58. During storage, the retractable belt 54 is positioned inside the retractable stanchion belt housing unit 14. The extendable pole 12 may be collapsed or remain in an extended configuration.

Figure 4:
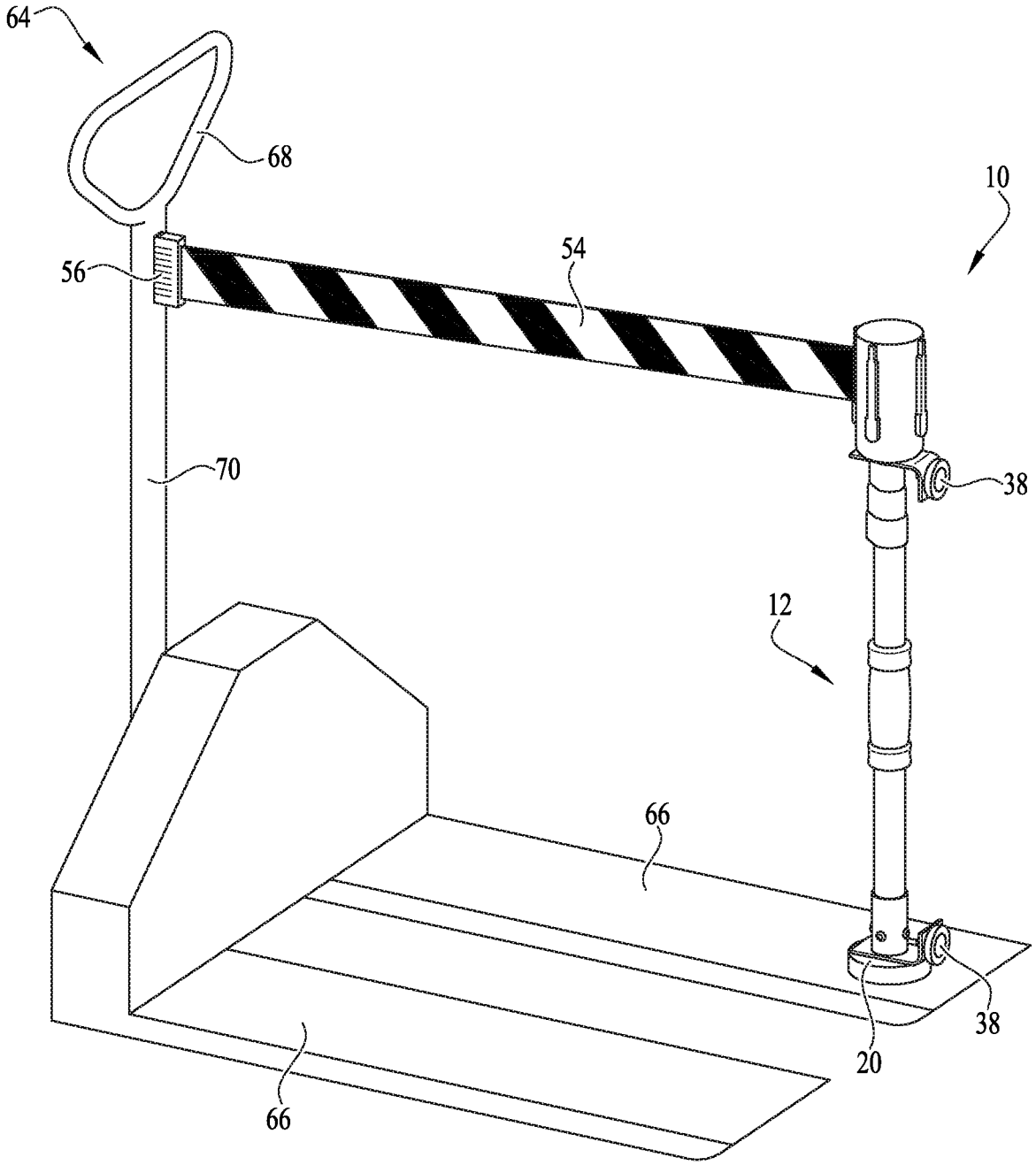
FIG. 4 illustrates a perspective view of the apparatus in use on an idle pallet jack.

Referring to FIG. 4, the apparatus 10 is placed atop a pallet jack 64. In this configuration, the bottom post 20 is magnetically affixed to a pallet jack fork 66. The user will preferably extend and lock the extendable pole 12 at a height by which to alert pedestrians of the pallet jack fork 66 thereby preventing pedestrians from walking and tripping over the pallet jack fork 66. The retractable belt 54 is extended and the belt magnet 56 is affixed to a portion of the pallet jack 64 such as the handle 68 or tow bar 70. Although a user may accomplish the goal of alerting pedestrians of the presence of a pallet jack fork 66 with one apparatus 10, the user may elect to use an additional apparatus 10 to place atop a second pallet jack fork 66 and extend the retractable belt 54 to the handle 68 or tow bar 70.

Figure 5:
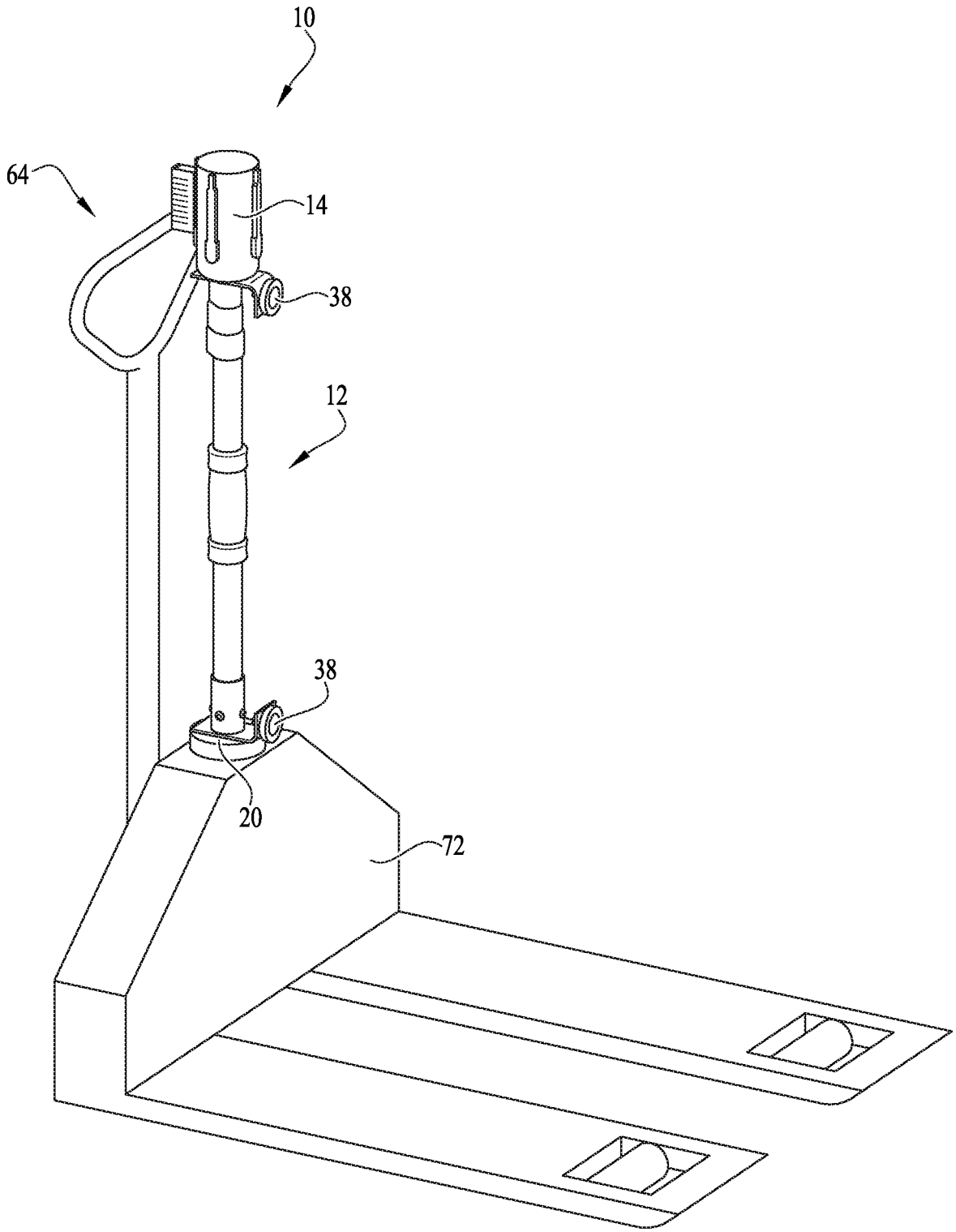
FIG. 5 illustrates perspective view of the apparatus affixed to the frame of a pallet jack during storage.

Referring to FIG. 5, the apparatus 10 is placed atop the pallet jack 64 for storage during pallet jack 64 use. In this configuration, the bottom post 20 is magnetically affixed to the A-frame 72 of the pallet jack 64. During storage, the retractable belt 54 (not shown) is positioned inside the retractable stanchion belt housing unit 14 and the extendable pole 12 is preferably in a collapsed configuration as to not interfere with a user's line of sight when operating the pallet jack 64.

Figure 6:
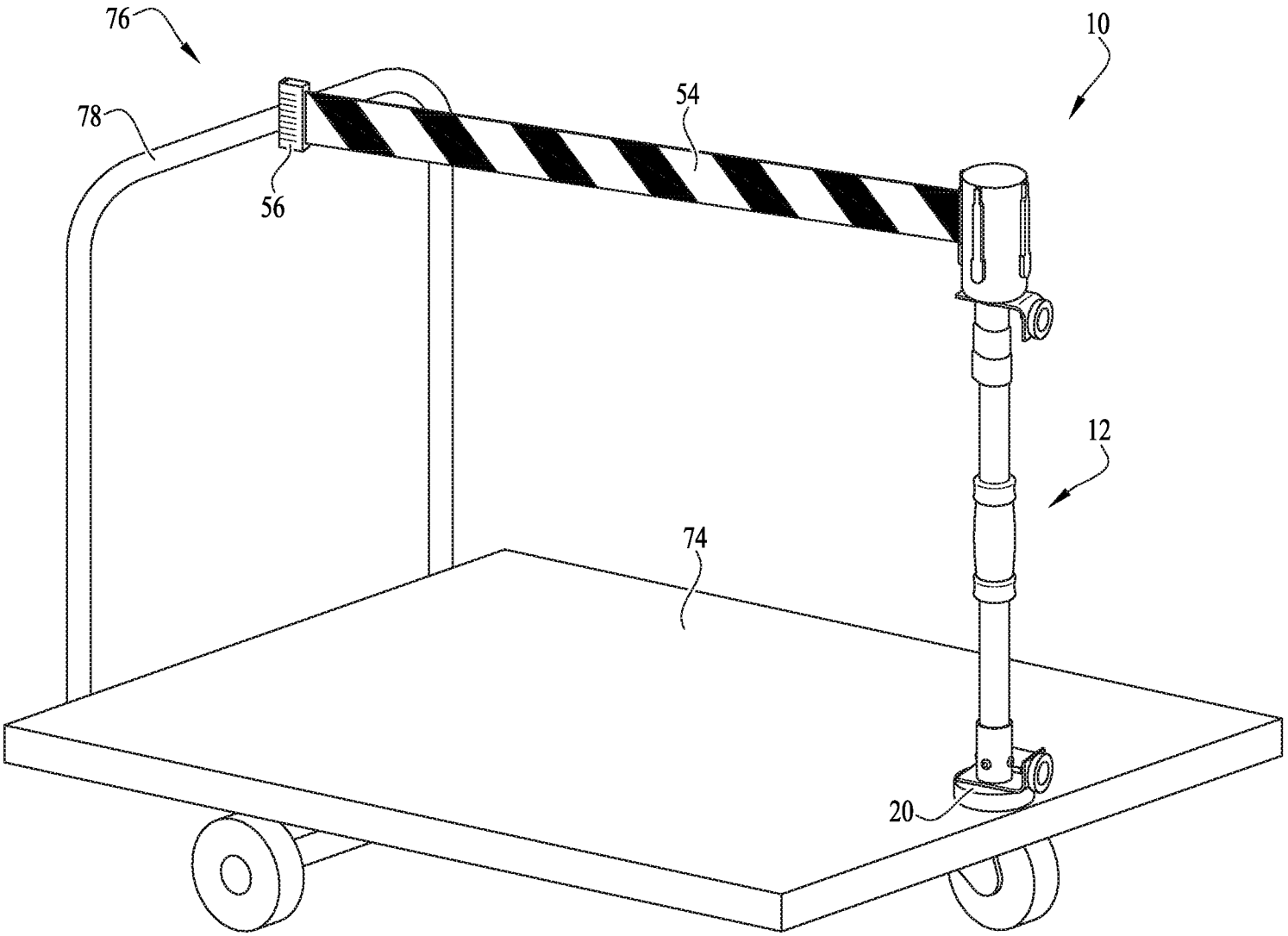
FIG. 6 illustrates a perspective view of the apparatus in use on an idle platform truck bed.

Referring to FIG. 6, the apparatus 10 is placed atop a platform truck 76. In this configuration, the bottom portion 20 is magnetically affixed to the flatbed 74 of the platform truck 76. The user will preferably extend and lock the extendable pole 12 at a height by which to alert pedestrians of the flatbed 74 thereby preventing pedestrians from walking into and tripping over the flat bed 74. The retractable belt 54 is extended and the belt magnet 56 is magnetically affixed to the platform truck handle 78. Although a user may accomplish the goal of alerting pedestrians of the presence of the flatbed 74 with one apparatus 10, the user may elect to place additional apparatus 10 atop the flatbed 74 and extend the retractable belt 54 to magnetically affix to the platform truck handle 78.

Figure 7:
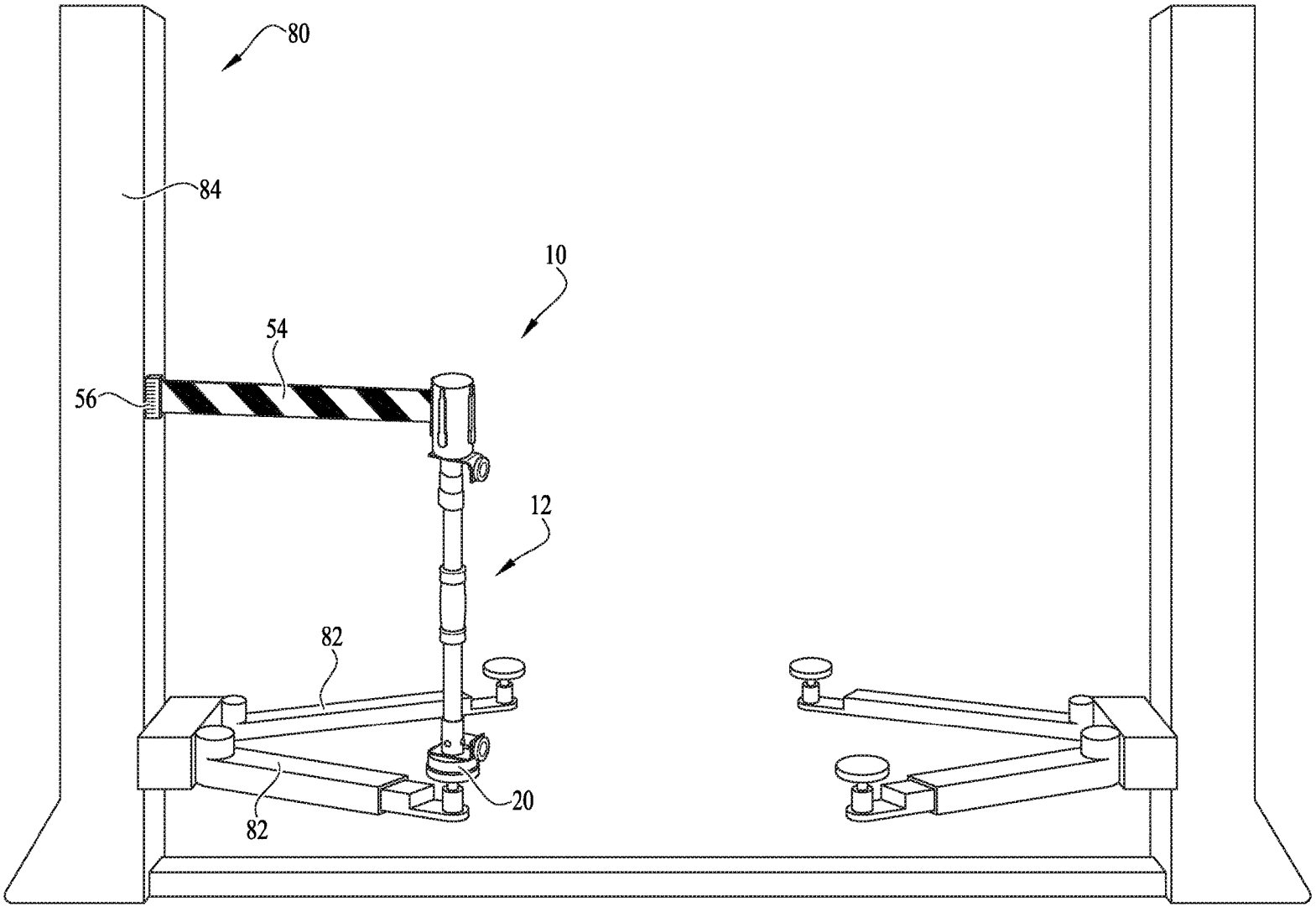
FIG. 7 illustrates a perspective view of the apparatus in use on an idle car lift.

Referring to FIG. 7, the apparatus 10 is placed atop a car lift 80. In this configuration, the bottom portion 20 is magnetically affixed to a floor plate 82 of the car lift 80. The user will preferably extend and lock the extendable pole 12 at a height by which to alert pedestrians of the floor plate 82 thereby preventing pedestrians from walking into and tripping over the floor plate 82. The retractable belt 54 is extended and the belt magnet 56 is magnetically affixed to a car lift post 84 or other vertical component of the car lift 80. Although a user may accomplish the goal of alerting pedestrians of the presence of a floor plate 82 with one apparatus 10, the user may elect to place additional apparatus 10 atop an adjacent floor plate 82 and extend the retractable belt 54 to an adjacent car lift post 84.

The foregoing descriptions of embodiments have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

Insofar as the description above and the accompanying drawings disclose any additional subject matter that is not within the scope of the claims below, the inventions are not dedicated to the public and the right to file one or more applications to claim such additional inventions is reserved.

What is claimed is:

1. A method for preventing tripping over a material handling machine having a substantial vertical portion and a substantial horizontal portion proximate the ground with a distal end extending into an aisle, the method comprising the steps of:

attaching a pole to the distal end of the substantial horizontal portion extending upwardly when the material handling machine is idle;

extending horizontally a retractable barrier from proximate a top end of the pole towards the substantial vertical portion and attaching the retractable barrier thereto when the material handling machine is idle;

detaching the retractable barrier from the substantial vertical portion when preparing to use the material handling machine;

detaching the pole from the substantial horizontal portion when preparing to use the material handling machine; and, attaching the pole to the substantial vertical portion when preparing to use the material handling machine.

2. The method of claim 1 further comprising the step of adjusting the length of the pole.

3. The method of claim 1 wherein the attaching steps comprise positioning a magnet proximate the material handling machine.

* * * * *